US006870455B2

(12) United States Patent
Meyer

(10) Patent No.: US 6,870,455 B2
(45) Date of Patent: Mar. 22, 2005

(54) SYSTEM AND METHOD FOR HIGH ACCURACY ACTIVATION OF A MECHANISM VIA A SOLENOID

(75) Inventor: Jeffry R. Meyer, Greensburg, PA (US)

(73) Assignee: ABB Inc., Raleigh, NC (US)

( * ) Notice: Subject to any disclaimer, the term of this patent is extended or adjusted under 35 U.S.C. 154(b) by 157 days.

(21) Appl. No.: 10/082,824

(22) Filed: Oct. 19, 2001

(65) Prior Publication Data

US 2002/0118087 A1 Aug. 29, 2002

Related U.S. Application Data

(63) Continuation of application No. 09/564,439, filed on May 4, 2000, now abandoned, which is a continuation of application No. 09/086,553, filed on May 28, 1998, now abandoned.

(51) Int. Cl.[7] ..... H01F 3/00
(52) U.S. Cl. ..... 335/251; 335/262
(58) Field of Search ..... 335/251, 253, 335/255–261, 262, 270–271, 277–279

(56) References Cited

U.S. PATENT DOCUMENTS

| | | | | |
|---|---|---|---|---|
| 2,842,334 A | | 7/1958 | Short | |
| 3,777,294 A | | 12/1973 | Grenier | |
| 3,838,370 A | | 9/1974 | Ueno et al. | |
| 3,988,706 A | | 10/1976 | Springer | |
| 4,008,876 A | | 2/1977 | Bastle | |
| 4,062,052 A | * | 12/1977 | Harper et al. | 335/63 |
| 4,713,639 A | * | 12/1987 | Grunert et al. | 335/172 |
| 5,460,146 A | | 10/1995 | Frankenberg | |

FOREIGN PATENT DOCUMENTS

| | | |
|---|---|---|
| GB | 2 042 270 A | 9/1980 |
| GB | 2 116 776 A | 9/1983 |

OTHER PUBLICATIONS

Lucas, "Low Profile Solenoids", *Ledex Actuation Products Catalog*, 1993, Catalog # 101, E2–E3, (no month).

* cited by examiner

*Primary Examiner*—Lincoln Donovan
(74) *Attorney, Agent, or Firm*—Woodcock Washburn LLP

(57) ABSTRACT

A novel solenoid assembly is shown to include a solenoid having an armature and a delay member. The delay member delays movement of the armature from a first position to a second position until some desired condition occurs, for example, until a desired period of time has passed, until the solenoid is capable of generating a desired amount of force or until the current applied to the solenoid reaches a desired level. In a preferred embodiment, the delay member is a spring positioned to bias the armature against movement until the desired condition has occurred. In such an embodiment, the spring may be positioned to exert force against a shoulder formed on the armature. It is also preferred for the solenoid assembly to include a spacer, positioned between the solenoid and the mechanism being controlled by the solenoid. The spacer serves to space the armature from the mechanism when the armature is in the first position. In a further embodiment, the solenoid assembly further includes an extension member attached to the armature. In a still further embodiment of the invention, a body having a mass is attached to the armature for movement with the armature. In another embodiment, a method is provided for activating the mechanism including delaying the movement of the armature from the first position to the second position until such time as the armature force is greater than the maximum force necessary to activate the mechanism.

30 Claims, 2 Drawing Sheets

SYSTEM AND METHOD FOR HIGH ACCURACY ACTIVATION OF A MECHANISM VIA A SOLENOID

CROSS REFERENCE TO RELATED APPLICATIONS

The present application is a continuation of U.S. patent application Ser. No. 09/564,439, entitled "Solenoid Assembly For Use With High Accuracy Mechanisms" filed May 4, 2000, which is a continuation of U.S. patent application Ser. No. 09/086,553, filed May 28, 1998, now abandoned, entitled "Solenoid Assembly For Use With High Accuracy Mechanisms" which are both incorporated herein by reference in their entirety.

FIELD OF THE INVENTION

The present invention relates generally to the field of solenoid assemblies. More particularly, the present invention relates to solenoid assemblies used in precision applications in which the timing of the armature movement and the force exerted by the armature movement need to occur within precise limits.

BACKGROUND OF THE INVENTION

A solenoid is a device which converts electrical energy into mechanical movement. It consists primarily of two parts, a coil and an armature. Generally, the coil is formed from wire which has been wound into a cylindrical shape. The armature is mounted to move or slide axially within the cylindrically shaped coil. An electrical signal applied to the coil generates an electromagnetic field. The electromagnetic field causes the armature to move axially within the coil.

The coil and armature are usually mounted in a casing. The structure of the casing and armature are designed to limit the amount of armature movement, i.e., to limit stroke distance. Typically, when an electrical signal is applied to the coil and the resulting electromagnetic field causes the armature to move, a plate attached to the armature strikes the casing, stopping armature movement.

Solenoids of various types have been used for many years to operate mechanisms requiring some form of lateral, vertical, horizontal or axial motion. In some instances, solenoids are used to control mechanisms that contain precharged forces, i.e., mechanisms which retain tensioned springs, pressurized air or pressurized oil. The precharged forces are released from such mechanisms by valving or latching systems. Typically, the valving or latching systems are controlled by the motion of a solenoid. Consequently, applying an electrical signal to the solenoid will result in the release of the precharged force. An example of such a precharged mechanism is a circuit breaker found in power distribution systems.

In many instances, circuit breakers are hydraulically controlled, i.e., a hydraulic fluid is used to cause movement in the circuit breaker to break or make electrical contact, i.e., to open or close the circuit breaker. Pressurized hydraulic fluid is passed through a changeover valve. Depending on the position of the valving components in the changeover valve, pressurized fluid will be applied to the circuit breaker causing it to either open or close. For such circuit breakers, the valving or latching systems must act very quickly, i.e., on the order of 30–60 milliseconds. In the past, solenoids have been developed which exhibit movement to adequately achieve the necessary valving or latching speed.

However, recent developments in the area of power distribution systems and in the electronic designs used in such systems, have created a need to operate circuit switching devices much more accurately. For example, some present designs will attempt to either open or close circuit switching devices at particular points within an alternating current (AC) cycle, i.e., at particular points on the AC sine wave. In such applications, accuracy, under all operating conditions, to within a few tenths of a millisecond is needed to make such schemes practical. Such accuracy is not possible with traditionally designed solenoid assemblies.

Moreover, the valving and latching systems which control operation of circuit switching devices tend to vary their response to solenoid control in relation to the amount of time which has passed since the last solenoid movement. Using the above example, changeover valves may be harder to open or close depending on how long the valving components have maintained their present state. In such cases, a greater force is needed to operate the valve system. In other words, the force necessary to operate the changeover valve will vary over time.

These two circumstances, namely, the timing required by contemporary circuit designs and the varying over time of the force required to effectuate operation, leads to unacceptably high inaccuracies using traditional solenoid assemblies.

Consequently, a need still exists for a solenoid assembly which is capable of generating sufficient force at a precise time.

SUMMARY OF THE INVENTION

The above described problems are resolved and other advantages are achieved in a solenoid assembly having an armature and a delay member. The delay member is positioned to delay movement of the armature from a first position to a second position until some desired condition occurs, for example, until a desired period of time has passed, until the solenoid is capable of generating a desired amount of force or until the current applied to the solenoid reaches a desired level.

In a preferred embodiment, the delay member is a spring positioned to bias the armature against movement until the desired condition has occurred. In such an embodiment, the spring may be positioned to exert force against a shoulder formed on the armature. In such an embodiment, it is also preferred for the solenoid assembly to include an extension member attached to the armature. In such an arrangement, it is preferable for one end of the spring to exert force against a shoulder formed on the extension member. In another embodiment of the invention, a body having a mass is attached to the armature for delaying movement of the armature. It is also desirable to use the body attached to the armature in conjunction with the spring.

It is also preferred for the solenoid assembly to include a spacer, positioned between the solenoid and the mechanism being controlled by the solenoid. The spacer serves to space the armature from the mechanism when the armature is in the first position. Such spacing permits the armature assembly to build up a degree of kinetic energy prior to impacting the mechanism.

BRIEF DESCRIPTION OF THE DRAWINGS

The present invention will be better understood, and its numerous objects and advantages will become apparent to those skilled in the art by reference to the following detailed description of the invention when taken in conjunction with the following drawings, in which.

DETAILED DESCRIPTION OF ILLUSTRATIVE EMBODIMENTS

Figure 1:
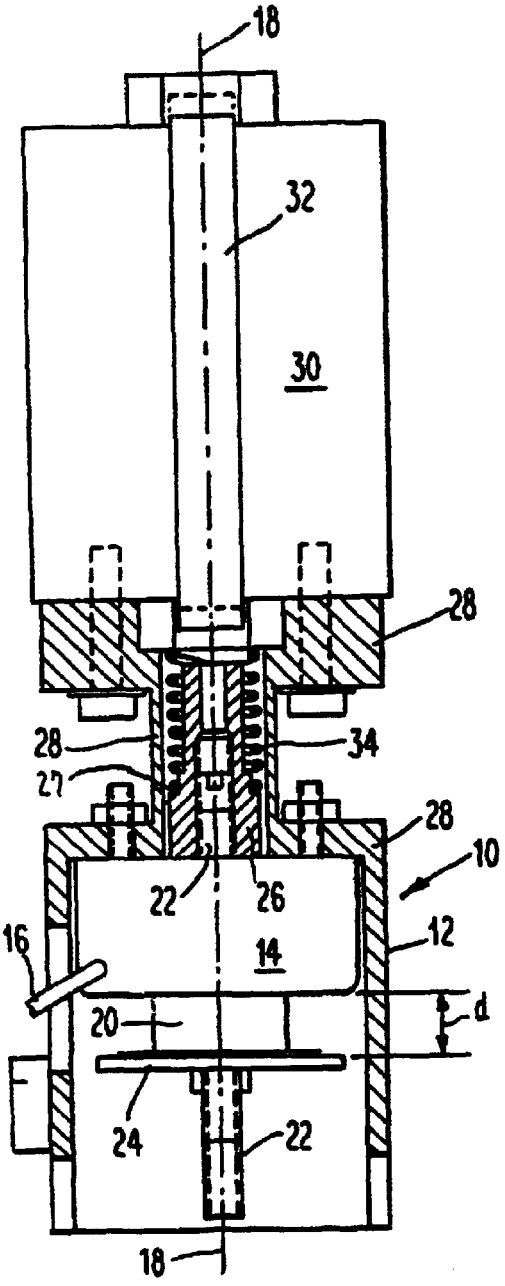
FIG. 1 is a partial section, front view of a solenoid assembly constructed in accordance with the present invention and attached to a changeover valve.

Referring to the drawings wherein like numerals indicate like elements throughout, there is shown in FIG. 1 a solenoid assembly 10. Solenoid assembly 10 is shown to include a housing 12 to which is attached a solenoid 14.

Solenoid 14 includes a coil (not shown) to which an electrical signal is applied via conductor 16. Although not shown, it is noted that in the embodiment depicted in FIG. 1, the coil of solenoid 14 is cylindrically shaped and positioned to be aligned with central axis 18. Solenoid 14 also includes an armature 20 which is aligned coaxially with the coil on central axis 18. Energizing the coil causes armature 20 to move axially along central axis 18. As depicted in FIG. 1, the coil has not been energized and armature 20 is in its initial state or first position.

Rod 22 is attached to armature 20 such that as armature 20 moves in response to the energization of the coil, rod 22 moves axially along central axis 18. Axial movement of armature 20 is limited by stop plate 24. Stop plate 24 is also securely attached to armature 20. As armature 20 moves axially, stop plate 24 strikes the casing of solenoid 14 halting the axial movement. As shown in FIG. 1, energization of the coil causes armature 20 to move axially a distance "d". Still referring to FIG. 1, it will be seen that a portion of rod 22 extends from the other side of solenoid 14. An extension member 26 is securely attached to rod 22. It will be appreciated that as rod 22 moves axially along central axis 18, extension member 26 will move likewise.

It is noted that solenoid 14 is attached to one end of a frame 28 and that a mechanism or changeover valve 30 is attached to the other end. As will be described in greater detail below, frame 28 serves as a spacer to space the end face of extension 26 from the contact face of valve element 32. Contact between the end face of extension member 26 and the contact face of valve member 32 is necessary for valve member 32 to move.

A delay member 34 is positioned in frame 28 between changeover valve 30 and solenoid 14. In the embodiment shown in FIG. 1, delay member 34 is a spring. One end of spring 34 rests against the face of changeover valve 30 while the other end of spring 34 rests on a shoulder 27 formed in extension member 26. Spring 34 is preferably aligned coaxially with central axis 18. It will be appreciated that during operation, energization of the coil causes armature 20 to move axially. This axial movement causes rod 22 and extension member 26 to also move axially. Axial movement of extension member 26 is resisted or impeded by the force exerted by spring 34. As will be explained in greater detail below, spring 34 serves to delay the movement of armature 20 from its initial or first position to its second or end position for either a desired period of time, until the current in the coil reaches a desired level or until solenoid 14 is capable of causing armature 20, and therefore extension member 26 through arm 22, to exert a desired amount of force.

Figure 2:
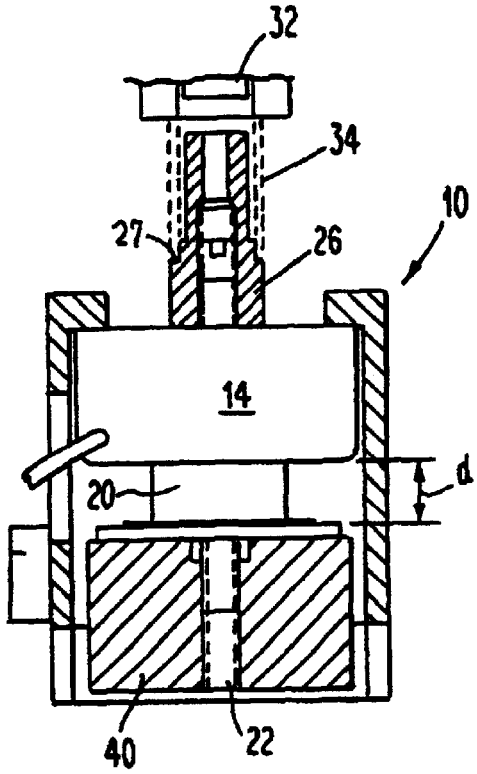
FIG. 2 is a partial section view of an alternative embodiment of the solenoid assembly depicted in FIG. 1, wherein a body has been attached to the armature.

Referring now to FIG. 2, an alternative embodiment of solenoid assembly 10 is depicted. In this embodiment, a body 40 is securely attached to rod 22, so that movement of armature 20 also results in movement of rod 22 and body 40. Body 40 can be of any type of material. The only limitation to body 40 is that it have a mass which is sufficient to delay armature 20 when the coil in solenoid 14 is energized.

Figure 3:
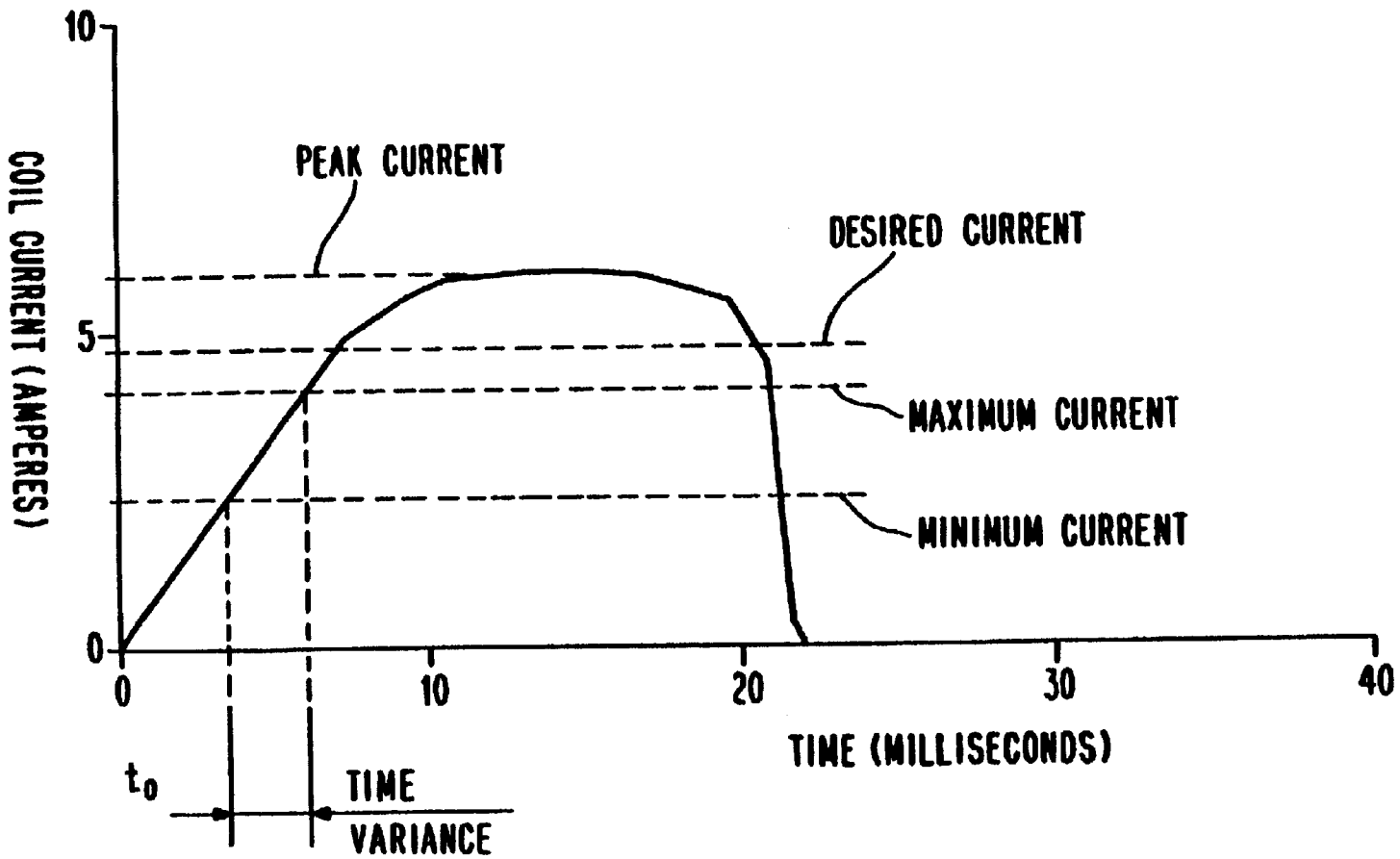
FIG. 3 is graph of current versus time for the solenoid assembly depicted in FIG. 1.

In order to fully appreciate the significance of spring 34 and body 40, one must consider operation of solenoid 14 in greater detail. Referring now to FIG. 3, a graph is shown of current in the coil of solenoid 14 from time $t_0$ to a time when the coil is fully energized. It will be appreciated that the force exerted by armature 20 through arm 22 and extension member 26 will be dependent upon the strength of the electromagnetic field created by the coil in solenoid 14. It will also be appreciated that the strength of the magnetic field created by the coil in solenoid 14 is related to the amount of current in the coil. Because a coil possesses a significant inductance characteristic, the current in the coil will appear generally as shown in FIG. 3.

At time $t_0$, an electrical signal is applied to conductor 16. Since the coil possesses a significant inductive characteristic, the current in the coil will rise from zero to a peak current over a period of time, for example 10 milliseconds. While the current is rising, the strength of the electromagnetic field generated by the coil is also rising. Consequently, as the current rises, the force exerted by armature 20 also rises. For the changeover valve depicted in FIG. 1, a minimum current level is required in order for armature 20 to exert enough force to move valve element 18 under ideal conditions.

It will be recalled from above, that ideal conditions occur when only a short period of time has passed since the last movement of valve element 32. If a relatively longer period of time has passed since the last movement of valve element 32, a certain degree of sticking is exhibited by valve element 32. In order to overcome the sticking condition, it is necessary for armature 20 to exert even more force. Accounting for the sticking condition, a maximum current level is shown in FIG. 3. The maximum current level is that level which is necessary in order to generate an electromagnetic field having sufficient strength to cause armature 20 to exert enough force to overcome a sticking condition.

A desired current level would be one which is greater than both the minimum and maximum currents required to cause movement of valve element 32. By operating solenoid 14 at the desired current level, one can be assured that valve element will move regardless of the time that has passed since valve element 32 last moved.

One problem associated with the use of solenoids to control operation of devices such as change over valves is that one does not always know the conditions to which valve element 32 has been subjected. In other words, one does not always know the time which has lapsed since valve element 32 was last moved. Accordingly, movement of valve element 32 without the use of the present invention, could require a buildup of current. While waiting for the necessary current level to be reached, time continues to pass. Accordingly, using traditional solenoid arrangements, three or four milliseconds can pass before the solenoid causes the armature to exert sufficient force. As indicated in the background of the invention section herein, such a time lapse is unacceptable when one wishes to cause movement of valve element 32 within a few tenths of a single millisecond at a particular point in time. It will be recalled that present developments call for the actuation of devices at particular points within a single cycle of alternating current, i.e., at a particular point within a time frame approximately 16.67 milliseconds long. In such schemes, a potential delay of two to four milliseconds (12.5% to 25% of the cycle) is unacceptable.

Use of the present invention causes the "firing" or movement of the armature of solenoid 14 to be delayed until the coil current reaches a desired level. Consequently, one can predict to within tenths of a millisecond when armature 20 will make contact with valve element 32 causing it to move. Use of the present invention also causes movement of armature 20 to be delayed or inhibited for a period of time or until armature 20 exerts a desired amount of force. Specifically, spring 34 is selected so that the force exerted by the spring causes armature 20 to initially remain in its first position until sufficient force is exerted to overcome the force of the spring and then move from its initial position to its final position. Spring 34 acts to hold armature 20 in its first position until the current in the coil reaches a desired level, as shown in FIG. 3. Considered another way, spring 34 acts to inhibit movement of armature 20 and prevents contact between the end face of extension member 26 and the contact face of valve element 32 until the coil current reaches the desired level.

Body 40, shown in FIG. 2, acts in a manner similar to spring 34. It will be seen from FIG. 2, that solenoid 14 is oriented vertically. Thus, in order for armature 20 to move vertically, the electromagnetic field generated by the solenoid coil must have sufficient strength to overcome the weight of body 40. Selecting material having an appropriate density and size determines the weight, i.e. force, which must be overcome to effect movement of armature 20. Selecting an appropriate weight will cause a delay in the end face of extension member 26 contacting the contact face of valve element 32. Spring element 34 is shown in phantom in FIG. 2, in order to illustrate the concept that body 40 and spring 34 could be used concurrently to delay or inhibit movement of armature 20.

It will be appreciated from the description of FIGS. 1 and 2 above that a gap exists between the end face of extension member 26 and the contact face of valve element 32. This gap or spacing is established by the dimensions of frame or spacer 28. One advantage of this spacing is to give extension member 26 a short period of time after movement begins before striking the contact face of valve element 32. This time permits armature 20, arm 22, extension member 26 and, in some embodiments, body 40 to generate a greater kinetic energy than would be generated if the end of extension member 34 were always kept in contact with valve element 32. It is noted that an embodiment which maintains contact between member 34 and element 32 is nonetheless envisioned to be within the scope of the present invention.

While the invention has been described and illustrated with reference to specific embodiments, those skilled in the art will recognize that modification and variations may be made without departing from the principles of the invention as described herein above and set forth in the following claims.

What is claimed is:

1. A method of activating a mechanism, wherein a force required to activate the mechanism varies between a minimum force and a maximum force in relation to the time since the mechanism was last activated, the method comprising:

applying an electrical current to a solenoid having an armature extending therefrom, wherein the armature is movable between a first end position and a second end position and wherein the electrical current of the solenoid causes the armature to exert an armature force, in the first end position the armature is spaced apart from and does not contact the mechanism and in the second end position the armature contacts the mechanism;

delaying, after applying the electrical current to the solenoid, the movement of the armature from the first end position to the second end position, with a force significantly greater than under normal operating conditions, until such time as the armature force is greater than the maximum force necessary to activate the mechanism; and impacting the mechanism with the armature after the armature has kinetic energy.

2. The method as recited in claim 1, wherein delaying comprises:

delaying, after applying the electrical current to the solenoid, the movement of the armature from the first end position to the second end position until such time as the armature force exhibits a preselected armature force that is greater than or equal to the maximum force necessary to activate the mechanism.

3. The method as recited in claim 1, further comprising:

contacting the armature to the mechanism after such time as the armature force is greater than the maximum force necessary to activate the mechanism.

4. The method as recited in claim 1, further comprising separating the end of the armature apart from the mechanism such that the armature does not contact the mechanism in the first end position, prior to applying the electrical current.

5. The method as recited in claim 1, wherein delaying comprises delaying the armature with a spring biasing the armature against movement from said first end position to said second end position.

6. The method as recited in claim 1, wherein delaying comprises exerting a force via a spring contacting a shoulder of the armature.

7. The method as recited in claim 1 wherein delaying comprises delaying the armature with a body having a mass biasing the armature against movement from said first end position to said second end position.

8. A solenoid assembly, for use in activating a mechanism, wherein a force required to activate said mechanism varies between a minimum force and a maximum force in relation to the time since said mechanism was last activated, said solenoid assembly comprising:

a solenoid having an armature extending therefrom, wherein said armature moves between a first end position and a second end position, in the first end position the armature is spaced apart from and does not contact the mechanism and in the second end position the armature is positioned to contact the mechanism, wherein when an electrical current is applied to said solenoid, said solenoid causes said armature to exert an armature force; and a delay member for delaying the movement of said armature, wherein after the initiation of an electrical current to said solenoid said delay member delays the movement of said armature from said first end position to said second end position, with a force significantly greater than under normal operating conditions, until such time as said armature exhibits an armature force greater than said maximum force necessary to activate said mechanism.

9. The solenoid assembly of claim 8, wherein said delay member comprises a spring positioned to bias said armature against movement from said first end position to said second end position.

10. The solenoid assembly of claim 9, wherein said armature comprises a shoulder and wherein said spring is positioned to exert force against said shoulder.

11. The solenoid assembly of claim 10, wherein the end of said armature is rod shaped, wherein said shoulder is formed on the outer periphery of said armature and said spring is positioned coaxially with said armature.

12. The solenoid assembly of claim 9 further comprising a spacer positioned between said solenoid and a mechanism requiring mechanical movement, so that when said armature is in said first end position the end of said armature is spaced apart from and does not contact said mechanism.

13. The solenoid assembly of claim 9, further comprising an extension member attached to said armature.

14. The solenoid assembly of claim 13, wherein said extension member comprises a shoulder, wherein said spring exerts force against said shoulder.

15. The solenoid assembly of claim 9, wherein said delay member comprises a body having a mass, said body being attached to said armature for movement with said armature, wherein said mass is sufficient to delay said armature from moving between said first end position and said second end position.

16. A solenoid assembly, for use in activating a mechanism wherein a force required to activate said mechanism varies in relation to the time since said mechanism was last activated, said solenoid assembly comprising:

a solenoid having an armature extending therethrough, wherein said armature moves between a first end position and an second end position, in the first end position the armature is spaced apart from and does not contact the mechanism and in the second end position the armature is positioned to contact the mechanism, wherein when an electrical current is applied to said solenoid, said solenoid causes said armature to exert an armature force; and a delay member for delaying the movement of said armature, wherein after the initiation of an electrical current to said solenoid said delay member delays the movement of said armature from said first end position to said second end position, with a force significantly greater than under normal operating conditions, until said armature exhibits a preselected armature force, necessary to activate said mechanism.

17. The solenoid assembly of claim 16, wherein said armature comprises a shoulder and wherein said delay member comprises a spring positioned to exert force against said shoulder.

18. The solenoid assembly of claim 17, wherein the end of said armature is rod shaped, wherein said shoulder is formed on the outer periphery of said armature and said spring is positioned coaxially with said armature.

19. The solenoid assembly of claim 16, wherein said solenoid assembly is adapted for use with a mechanism requiring mechanical movement, said solenoid assembly further comprising a spacer, positioned between said solenoid and said mechanism, so that when said armature is in said first end position the end of said armature is spaced apart from and does not contact said mechanism.

20. The solenoid assembly of claim 16, further comprising an extension member attached to said armature.

21. The solenoid assembly of claim 20, wherein said extension member comprises a shoulder, wherein said spring exerts force against said shoulder.

22. The solenoid assembly of claim 16, wherein said delay member comprises a body having a mass, said body being attached to said armature for movement with said armature, wherein said mass is sufficient to delay said armature from moving between said first end position and said second end position.

23. The method of claim 1, wherein delaying the movement of the armature and impacting the mechanism with the armature provide mechanism activation times consistent to within one millisecond.

24. The method of claim 1, wherein delaying the movement of the armature and impacting the mechanism with the armature provide mechanism activation times consistent to within two-tenths of a millisecond.

25. The method of claim 1, wherein delaying the movement of the armature and impacting the mechanism with the armature provide mechanism activation substantially at a predefined time after the beginning of an ac power cycle.

26. The method of claim 1, wherein delaying the movement of the armature and impacting the mechanism with the armature provide consistent mechanism activation within one millisecond of a predefined time after the beginning of an ac power cycle.

27. The method of claim 1, wherein delaying the movement of the armature and impacting the mechanism with the armature provide consistent mechanism activation within about two-tenths of a millisecond of a predefined time after the beginning of an ac power cycle.

28. The method of claim 1, wherein in the first end position the armature cannot contact the mechanism.

29. The solenoid assembly of claim 8, wherein in the first end position the armature cannot contact the mechanism.

30. The solenoid assembly of claim 16, wherein in the first end position the armature cannot contact the mechanism.

* * * * *